United States Patent [19]

Chlumecky

[11] Patent Number: 4,565,469

[45] Date of Patent: Jan. 21, 1986

[54] CRIBBING

[75] Inventor: Nicholas Chlumecky, Youngstown, Ohio

[73] Assignee: Commercial Shearing, Inc., Youngstown, Ohio

[21] Appl. No.: 670,951

[22] Filed: Nov. 13, 1984

Related U.S. Application Data

[63] Continuation-in-part of Ser. No. 411,583, Aug. 26, 1982, Pat. No. 4,497,597.

[51] Int. Cl.[4] ..... E21D 11/00

[52] U.S. Cl. ..... 405/288; 405/258; 405/303; 52/423

[58] Field of Search ..... 405/288, 258, 303; 299/11, 19; 106/90, 97; 52/600, 601, 596, 725, 726, 727, 728, 297

[56] References Cited

U.S. PATENT DOCUMENTS

| | | | |
|---|---|---|---|
| 762,496 | 6/1904 | Smith | 52/423 |
| 1,673,729 | 6/1928 | Barnes | 52/728 |
| 3,109,259 | 11/1963 | Viall | 52/596 X |
| 3,806,571 | 4/1974 | Ronnmark et al. | 264/333 X |
| 4,064,669 | 12/1977 | Vik | 52/423 X |
| 4,195,111 | 3/1980 | Rautenbach | 52/725 X |
| 4,330,632 | 5/1982 | Haynes et al. | 106/90 X |
| 4,393,018 | 7/1983 | Harbaugh et al. | 264/82 |

*Primary Examiner*—Dennis L. Taylor

*Attorney, Agent, or Firm*—Buell, Ziesenheim, Beck & Alstadt

[57] ABSTRACT

A crib member for forming underground cribbing is provided in the form of a concrete circle containing fibre reenforcing and preferably in the form of a donut shaped member. A plurality of such members is stacked one on top of another to form a cylindrical cribbing.

13 Claims, 5 Drawing Figures

CRIBBING

This application is a continuation-in-part of my copending application Ser. No. 411, 593, filed Aug. 26, 1982, now U.S. Pat. No. 4,497,597.

This invention relates to cribbing and particularly to cribbing for mines, tunnels and similar underground passages.

Cribbing of mine roofs, tunnels and similar underground passages to provide roof support has long been practiced. Such cribbing has universally been done using cribs made by assembling wooden blocks in an open or closed generally square vertical crib between the floor and roof at regular intervals. Wood has been used for cribbing because it is compressible and is the most commonly available material. In general, efforts to use concrete or other materials have been unsuccessful because of brittle or catastrophic failure of materials other than wood. While wood has proven to be virtually the only satisfactory material available for cribbing to date, it does have the disadvantage of relatively low compressive strength and Young's modulus and the further disadvantage of non-uniformity from piece to piece of wood depending upon its source, character, cut and composition, flammability, rot and deterioration with passage of time.

The present invention provides a form of concrete member which overcomes all of the disadvantages associated with both prior art concrete and wood crib members and provides unique advantages not heretofore available in any form of crib member. The crib member of this invention provides a larger bearing area than conventional crib structures. It will not rot and is not flammable. There are no sharp corners which penetrate roof or floor. It has much less resistance to air flow around the cribbing. It will deform over longer distances under compression while still maintaining load capacity. It yields by fracturing and expanding and compressing while being at least partially held together by its internal fibre reinforcing. In the preferred donut shaped form, the pieces released in breaking tend to fall into a center hole and thus even after yielding to some degree will not detrimentally affect air flow. Finally, the crib of this invention is circular and can be rolled to the position of use, reducing labor and heavy handling which is of great advantage when working in low coal seams.

In my original application I provided a crib member in the form of a concrete annulus formed within at least one annular metal retaining member so as to form a donut shaped crib member. The concrete is preferably plain concrete but it may be fibre reenforced. I have since found that the metal retaining member may be eliminated if the concrete is fibre reenforced. Preferably the concrete should contain about 50 lbs. to 100 lbs of steel fibres per cubic yard or its equivalent. The concrete is preferably made using a light weight, high strength aggregate such as expanded slate. The cribbing of this invention may be cast as an annulus or donut shape or as a solid circle, however, I prefer the donut shape because of its lighter weight, ease of installation and center hole for receiving debris. Both shapes are preferably cast with a planar matching face on top and bottom, however, a mating tongue on one side and groove on the opposite side may be provided if desired.

The cribbing of this invention keeps roofs tight, because it provides early load resistance. Timber cribbing has to be compressed to about 80% of its initial height until it reaches maximum capacity. With that much yielding, most mine roofs break up and excessive roof sag reduces the cross section which is available for ventilation. The cribbing of the invention will not shrink away from the mine roof after installation. Cribbing made from timber shrinks away from the mine roof and must be re-wedged frequently to maintain effectiveness. It exceeds the capacity of typical hardwood cribbing. Results of tests for maximum loads in the U.S. Bureau of Mines facility for typical cribbing were as follows:

| | |
|---|---|
| New 6" × 6" × 30" locust hardwood open cribbing | 158 tons |
| Four yr. old 6" × 6" × 30" mixed hardwood open cribbing | 78 tons |
| Fibre concrete donut cribbing according to this invention | 485 tons |

The cribbing according to this invention does not rot when stored or after installation. Fungicidal and bacterial action causes timber to loose its strength with time.

The cribbing according to this invention is economical and reduces the amount of material handling as compared with other concrete block cribbing. Comparison for 6 ft. high cribbing using the donut shape of this invention is set out hereafter:

| Crib Block: | 3⅝" × 7⅝" × 23" | 22" O.D. Donut |
|---|---|---|
| Wt. per pc. | 55# | 55# |
| Qty. to be handled per crib | 40 | 24 |
| Wt. per crib | 2,200# | 1,224# |

Use of the donut cribbing of this invention shows a 44% reduction of weight to be moved as compared with the concrete block cribbing of the prior art.

The cribbing according to this invention is made from fibre reinforced concrete with close quality control. Uniformity of quality is much greater than that for typical mine timber.

The cribbing of this invention is not subject to brittle failure. The steel fibres in the concrete used for cribbing according to the preferred form of this invention are uniformly dispersed and provide a reenforcing action.

The cribbing of this invention has a circular cross section which reduces resistance to ventilation air flow. A round cross section is known to be less resistant to air flow than a rectangular cross section.

The cribbing of the invention requires simple base preparation assuring use of available bearing area. Each layer of the donut cribbing consists of one layer. Therefore, misalignment between layers is impossible. Base preparation is simple. Look for level spot, rotate it a few times until it is firmly in place.

Considering the mining environment and with block type cribbing of the prior art, it may be difficult if not impossible to set down each crib piece exactly parallel on base material of uniform firmness. If the blocks are not set down parallel or if the base material settles unevenly, the block type cribbing components are subject to vulnerable, unequal point loading. This is eliminated by the present invention. Finally the cribbing of this invention can be rolled on its edge. This reduces back breaking lifting if the cribbing has to be moved manually in a low coal operation.

In the foregoing general description of my invention I have set out certain objects, purposes and advantages of my invention. Other objects, purposes and advantages of this invention will be apparent from a consideration of the following description and the accompaying drawings in which.

Figure 1:
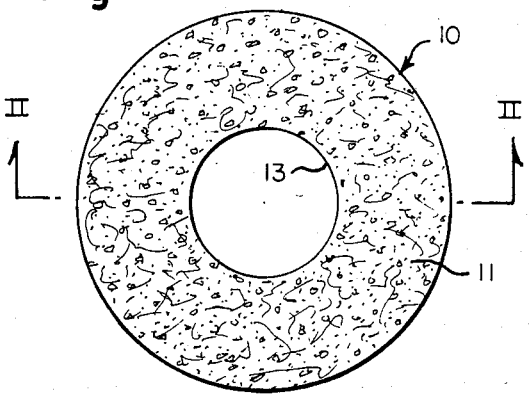
FIG. 1 is a top plan view of a crib member according to this invention.
Figure 2:
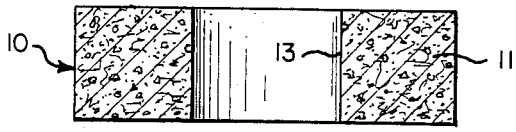
FIG. 2 is a section on the line II—II of FIG. 1.
Figure 3:
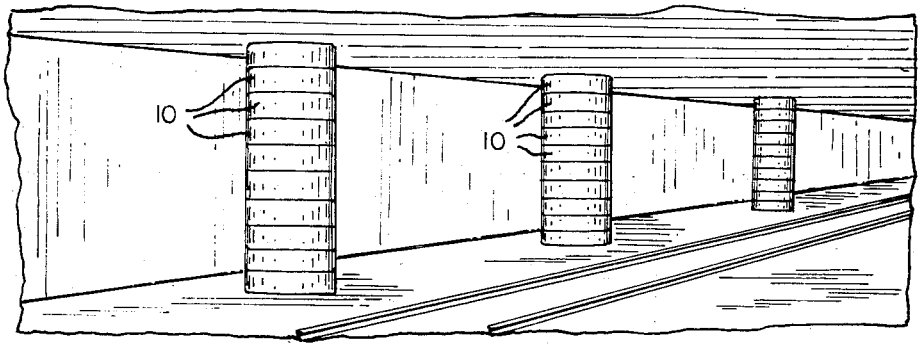
FIG. 3 is a side elevation of a cribbing formed in a mine using the crib member of FIGS. 1 and 2.

Referring to FIGS. 1 and 2, I have illustrated a crib member 10 of concrete 11 containing 80 lb. per cubic yard of steel fibres sold under the trade name "Fibercon" steel fibres and with expanded slate as the light weight aggregate and sold under the name "Stalite". The crib member 11 is preferably circular in shape and of small substantially uniform thickness relative to diameter and with an opening 13 in the center thereof to form an annulus or donut of concrete 11 as illustrated in FIGS. 1 through 4. A typical concrete mix would contain for each cubic yard about 470 lb. of cement (Type III), about 221 lb. of water, about 1500 lb. of sand, about 80 lb. of steel fibre, a small amount of accelerator and air entrainment solution and the balance a light weight aggregate. This annular or donut shape permits the cribbing to collapse gradually and yieldably rather than catastrophically. It is more readily installed, is more stable and reduces resistance to air flow as compared with conventional mine and tunnel cribbing. In use, the crib members may be rolled into place and stacked one upon another as shown in FIG. 3 from floor to roof to form a hollow cylindrical cribbing. If the pressure of the roof on the cribbing is so great that yielding occurs, the concrete will not be subject to brittle failure and sudden collapse but will allow controlled yielding by spalling, particularly into the center hole. It will not permit brittle, sudden or catastrophic failure such as occurred in prior art concrete cribbing attempts.

Figure 4:
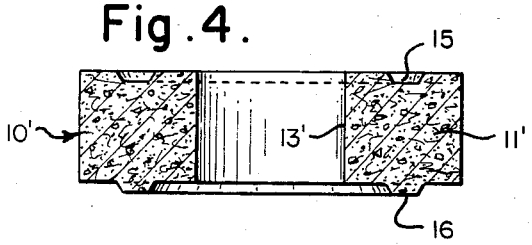
FIG. 4 is a section through a second embodiment of crib member according to my invention.

In FIG. 4, I have illustrated a second embodiment of my invention based generally on the structure of FIG. 1 with like parts bearing like numerals with a prime sign. In this embodiment the concrete annulus 11' is cast with an annular groove 15 on the top and an annular mating tongue 16 on the bottom. A central opening 13' is provided to complete the donut shape.

Figure 5:
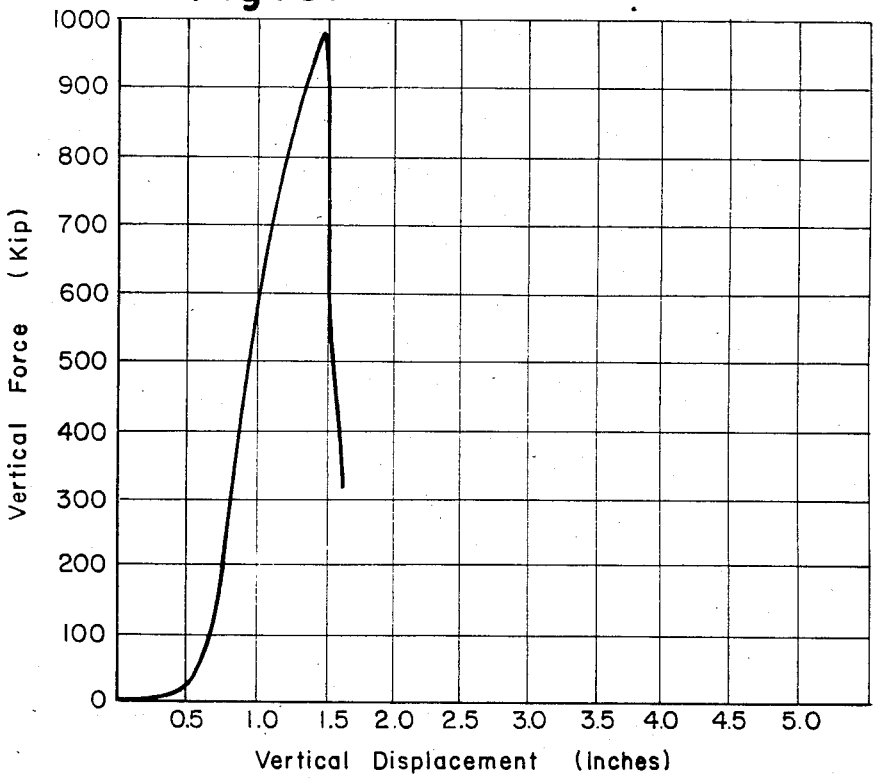
FIG. 5 is a graph of vertical displacement vs. vertical force for a simulated mine roof test on the donut shaped cribbing of this invention.

In FIG. 5, I have shown a graph of vertical displacement vs. vertical force in kip (1000 lbs.) for a donut cribbing according to this invention tested in a mine roof simulator and subjected to a maximum load of 970,000 lbs. (485 tons).

I have found that the use of fibre reenforcing in the concrete body will prevent catastrophic or brittle collapse of the concrete while the central opening permits both reduction in weight coupled with the desired yieldability with necessary support.

In the foregoing specification, I have set out certain preferred practices and embodiments of my invention, however, it will be understood that this invention may be otherwise embodied within the scope of the following claims.

I claim:

1. A crib member for use in superimposed layers as cribbing in an underground cavity such as a mine comprising a circular concrete member of small substantially uniform thickness relative to its diameter whereby each said member can be rolled into position on its outer periphery and stacked with full surface contact between successive members free of edge loading between member and the bottom member can be rotated about its axis to level an uneven base surface, said member being formed of fibre reenforced concrete whereby brittle failure is prevented.

2. A crib member as claimed in claim 1 wherein the circular concrete member is an annulus having a central opening.

3. A crib member as claimed in claim 1 or 2 wherein the fibre reenforcing is steel fibres.

4. A crib member as claimed in claim 1 or 2 wherein the concrete contains a light weight aggregate.

5. A crib member as claimed in claim 4 wherein the light weight aggregate is expanded slate.

6. A crib member as claimed in claim 1 or 2 wherein the fibre reenforcing is steel fibres and the concrete contains a light weight aggregate.

7. A crib member as claimed in claim 6 wherein the light weight aggregate is expanded slate.

8. A crib member as claimed in claim 1 or 2 wherein one of top and bottom surfaces is provided with an annular groove and the other surface with a mating annular rib.

9. A crib member as claimed in claim 3 wherein one of top and bottom surfaces is provided with an annular groove and the other surface with a mating annular rib.

10. A crib member as claimed in claim 4 wherein one of top and bottom surfaces is provided with an annular groove and the other surface with a mating annular rib.

11. A crib member as claimed in claim 5 wherein one of top and bottom surfaces is provided with an annular groove and the other surface with a mating annular rib.

12. A crib member as claimed in claim 6 wherein one of top and bottom surfaces is provided with an annular groove and the other surface with a mating annular rib.

13. A crib member as claimed in claim 7 wherein one of top and bottom surfaces is provided with an annular groove and the other surface with a mating annular rib.

* * * * *

UNITED STATES PATENT AND TRADEMARK OFFICE

CERTIFICATE OF CORRECTION

PATENT NO. : 4,565,469

DATED : January 21, 1986

INVENTOR(S) : NICHOLAS CHLUMECKY

It is certified that error appears in the above-identified patent and that said Letters Patent is hereby corrected as shown below:

Column 1, line 5, change "Ser. No. 441,593" to --Ser. No. 411,583--.

Column 2, line 23, change "loose" to --lose--.

Column 2, line 31, change "55#" to --51#--. (2nd occurrence)

Signed and Sealed this

*Twentieth* Day of *May 1986*

[SEAL]

*Attest:*

DONALD J. QUIGG

*Attesting Officer*

*Commissioner of Patents and Trademarks*

REEXAMINATION CERTIFICATE (1133rd)

United States Patent [19]

Chlumecky

[11] B1 4,565,469

[45] Certificate Issued Sep. 26, 1989

[54] CRIBBING

[75] Inventor: Nicholas Chlumecky, Youngstown, Ohio

[73] Assignee: Commercial Shearing, Inc., Youngstown, Ohio

Reexamination Request:
No. 90/001,683, Jan. 3, 1989

Reexamination Certificate for:

| | |
|---|---|
| Patent No.: | **4,565,469** |
| Issued: | **Jan. 21, 1986** |
| Appl. No.: | **670,951** |
| Filed: | **Nov. 13, 1984** |

Related U.S. Application Data

[63] Continuation-in-part of Ser. No. 411,583, Aug. 26, 1982, Pat. No. 4,497,597.

[51] Int. Cl.[4] ..... E21D 11/00

[52] U.S. Cl. ..... 405/288; 405/258; 405/303; 52/423

[56] References Cited

U.S. PATENT DOCUMENTS

| | | | |
|---|---|---|---|
| 154,393 | 8/1874 | Hill | 52/227 |
| 762,496 | 6/1904 | Smith | 52/423 |
| 931,466 | 8/1909 | Nellen | 248/351 |
| 1,647,925 | 11/1927 | May | 52/227 |
| 4,393,018 | 7/1983 | Harbaugh et al. | 264/82 |

*Primary Examiner*—Dennis L. Taylor

[57] ABSTRACT

A crib member for forming underground cribbing is provided in the form of a concrete circle containing fibre reenforcing and preferably in the form of a donut shaped member. A plurality of such members is stacked one on top of another to form a cylindrical cribbing.

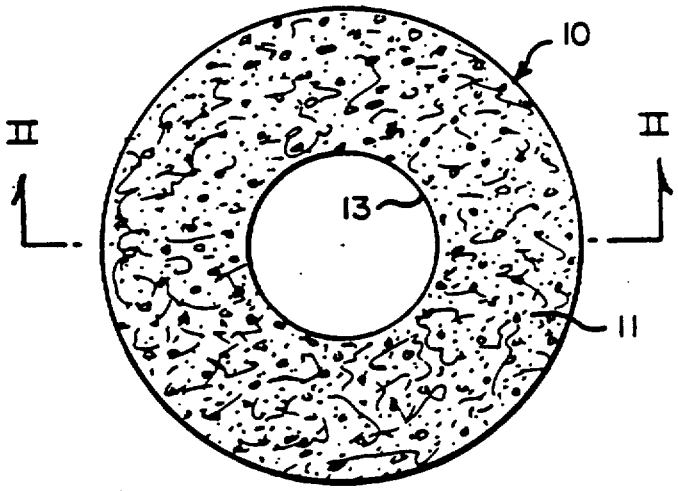

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *